US005419009A

United States Patent [19]

Assis et al.

[11] Patent Number: 5,419,009

[45] Date of Patent: May 30, 1995

[54] PACKAGING HANDLE

[76] Inventors: Rony Assis, 147-51 Jewel Ave.; Offer Assis, 147-28 69th Rd.; Jacob Assis, 147-43 Jewel Ave., all of Flushing, N.Y. 11367

[21] Appl. No.: 142,934

[22] Filed: Oct. 29, 1993

[51] Int. Cl.[6] ..... B65D 23/10

[52] U.S. Cl. ..... 16/124; 16/DIG. 24; 16/DIG. 25; 16/125; 229/117.22; 229/117.26

[58] Field of Search ..... 16/DIG. 12, DIG. 24, 16/DIG. 25, DIG. 40, 125, 124; 53/134.1, 413; 493/221, 88; 229/117.11, 117.22, 117.23, 117.26; 190/115

[56] References Cited

U.S. PATENT DOCUMENTS

| | | | |
|---|---|---|---|
| 1,524,399 | 1/1925 | Krueger | 493/88 |
| 1,829,533 | 10/1931 | Ondricek | 229/117.23 |
| 1,909,368 | 5/1933 | Lloyd | 229/117.11 |
| 2,059,643 | 11/1936 | Kobler et al. | 229/117.23 |
| 2,179,037 | 11/1939 | Goldschmidt | 229/117.23 |
| 2,194,232 | 3/1940 | Peters | 229/117.22 |
| 3,031,359 | 4/1962 | Blank et al. | 229/117.26 |
| 3,656,205 | 4/1972 | Anderson | 16/125 |
| 4,679,823 | 7/1987 | Nagy | 229/117.26 |
| 4,735,601 | 4/1988 | Cinotti | 493/88 |
| 4,981,255 | 1/1991 | Schulz | 229/117.22 |

*Primary Examiner*—Lowell A. Larson
*Assistant Examiner*—Donald M. Gurley
*Attorney, Agent, or Firm*—Michael I. Kroll

[57] ABSTRACT

An improved packaging handle is provided which consists of a strap member with a structure for adhering the strap member to a top surface of a package. A component for grasping is located at the center of the strap member, so that a person can carry the package with one hand therefrom.

17 Claims, 3 Drawing Sheets

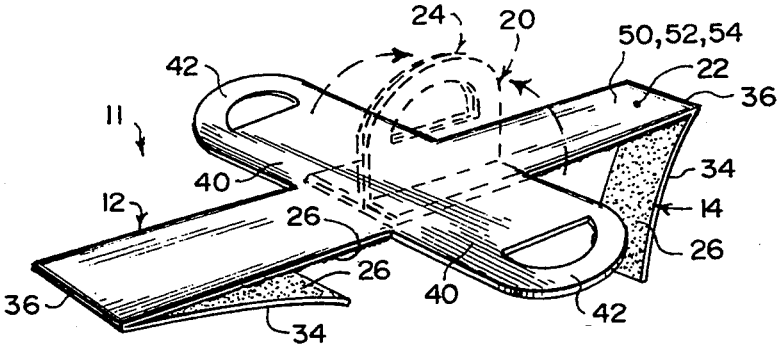
Fig. 6
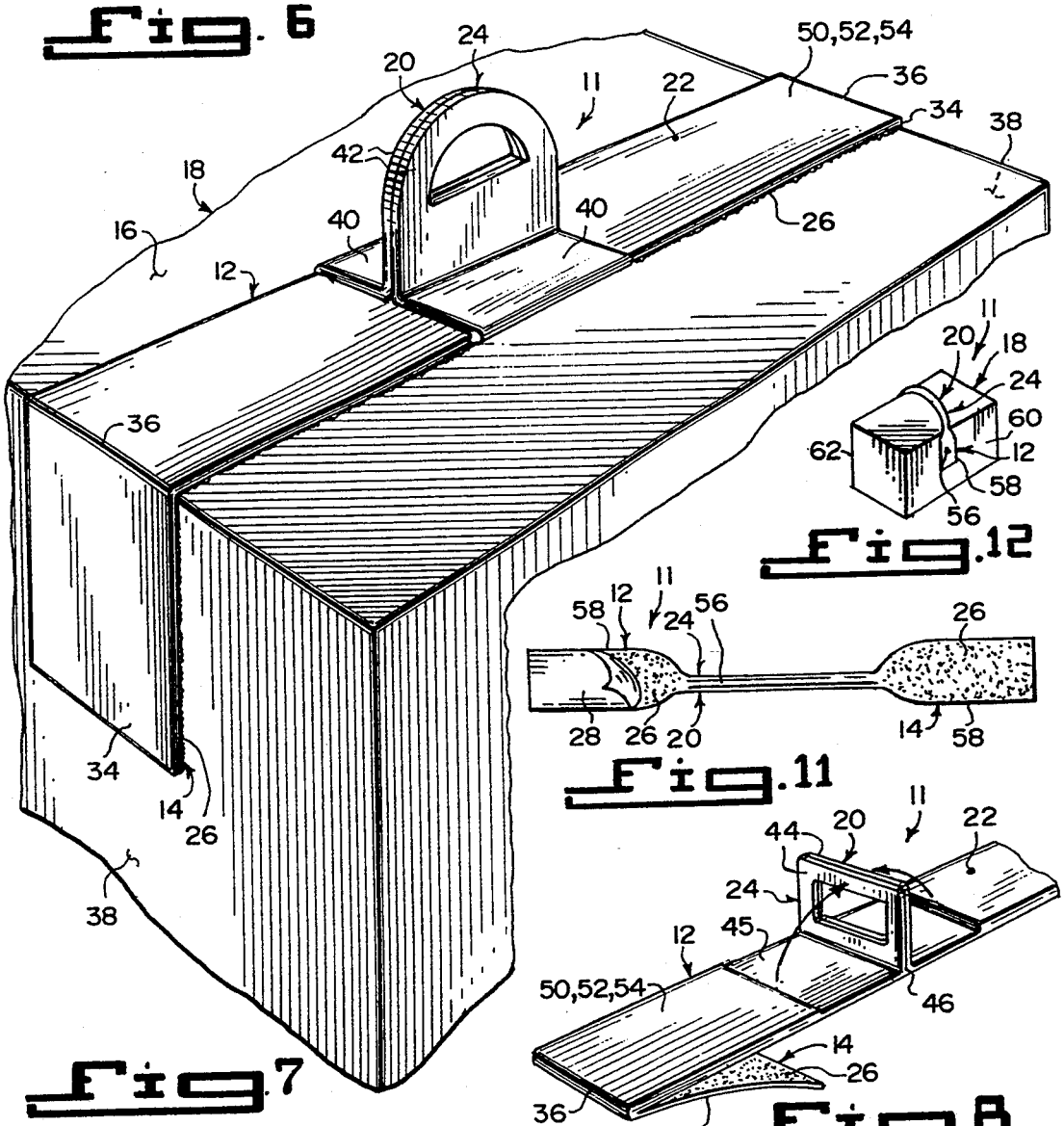
Fig. 7
Fig. 12
Fig. 11
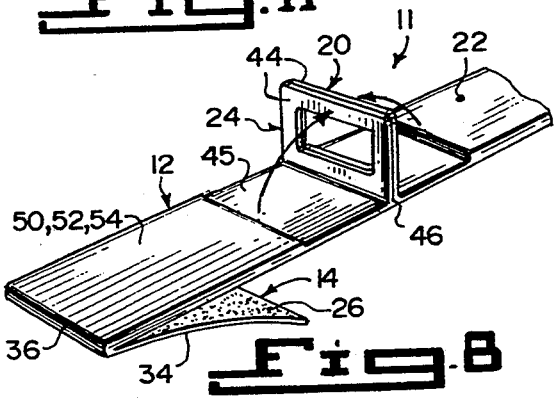
Fig. 8

36

PACKAGING HANDLE

BACKGROUND OF THE INVENTION

1. Field of the Invention

The instant invention relates generally to carrying devices and more specifically it relates to an improved packaging handle.

2. Description of the Prior Art

Numerous carrying devices have been provided in prior art that are utilized by being attached to parcels and similar articles which have been tied with cord or wire, so that the carrying devices can be held with the hand to deliver the parcels to other locations. While these units may be suitable for the particular purpose to which they address, they would not be as suitable for the purposes of the present invention as heretofore described.

SUMMARY OF THE INVENTION

A primary object of the present invention is to provide an improved packaging handle that will overcome the shortcomings of the prior art devices.

Another object is to provide an improved packaging handle that contains a strap member which can be attached to a package with adhesive, so that a grasping component can be engaged by the hand of a person to carry the package therefrom.

An additional object is to provide an improved packaging handle in which the strap member can be imprinted with indicia for advertising purposes.

A further object is to provide an improved packaging handle that is simple and easy to use.

A still further object is to provide an improved packaging handle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 6 is a top perspective view of a second embodiment of the instant invention.

FIG. 7 is a top perspective view showing the second embodiment attached to a package that is broken away.

FIG. 8 is a top perspective view of a third embodiment of the instant invention with parts broken away.

FIG. 11 is a bottom view of a fifth embodiment of the instant invention,

FIG. 12 is a top perspective view of the fifth embodiment attached to a package,

DETAILED DESCRIPTION OF THE PREFERRED EMBODIMENTS

Figure 1:
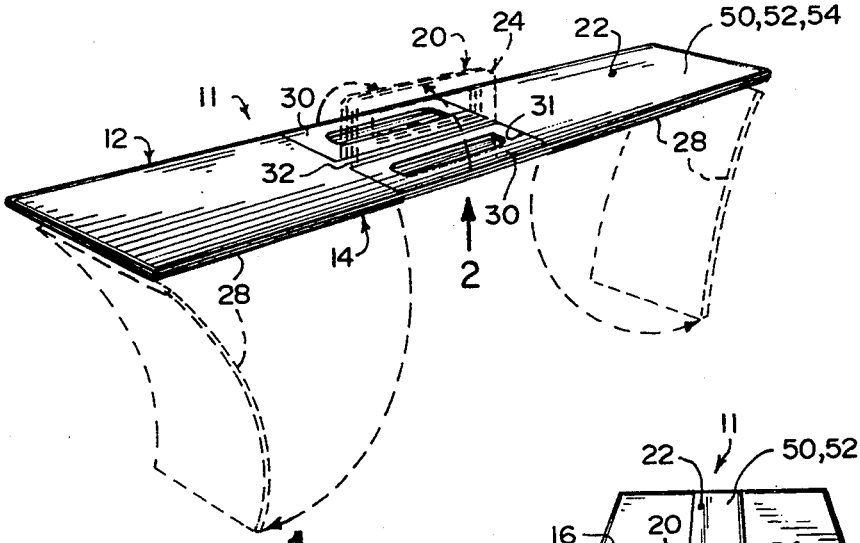
FIG. 1 is a top perspective view of a first embodiment of the instant invention.

Turning now descriptively to the drawings, in which similar reference characters denote similar elements throughout the several views, FIGS. 1 through 12 illustrate an improved packaging handle 11, which consists of a strap member 12. A structure 14 is for adhering the strap member 12 to a package 18. A component 20 for grasping is on the strap member 12, so that a person can carry the package 18 therefrom with one hand.

The strap member 12 is fabricated out of a narrow flat thin piece of pliant material 22. The grasping component 20 is a grip member 24. The grip member 24 is fabricated out of a narrow flat thin piece of pliant material 22. The strap member 12 and the grip member 24 are integral and fabricated out of the same narrow flat thin piece of pliant material 22.

Figure 2:
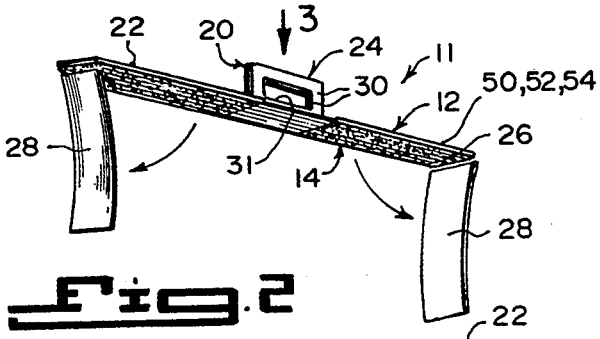
FIG. 2 is a bottom perspective view of the first embodiment taken in the direction of arrow in FIG. 1.
Figure 4:
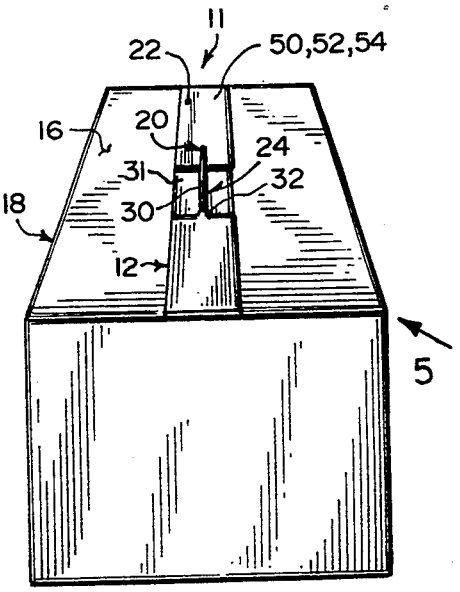
FIG. 4 is a top perspective view showing the first embodiment attached to a package.
Figure 3:
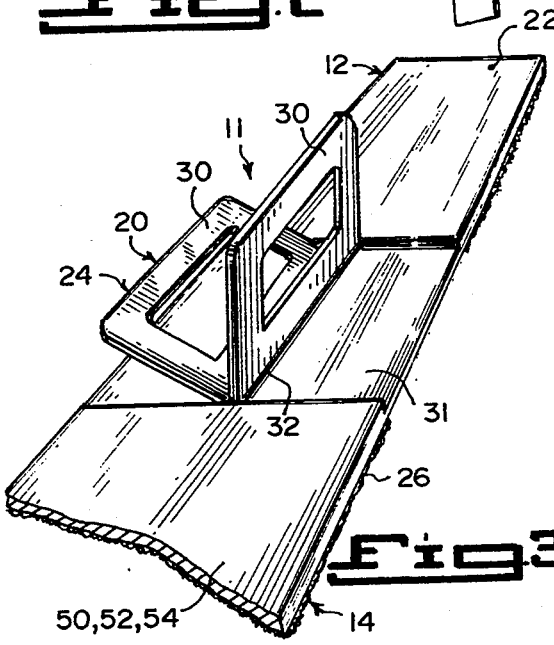
FIG. 3 is an enlarged top perspective view of the first embodiment with parts broken away taken in the direction of arrow 3 in FIG. 2.

As best seen in FIGS. 1 through 3, the adhering structure 14 includes adhesive material 26, applied to an inner surface of the strap member 12. Protective strips 28 are applied to the adhesive material 26. When the protective strips 28 are manually removed, the adhesive material 26 will be exposed to allow the strap member 12 to stick fast to a top surface 16 of the package 18.

The grip member 24 consists of a pair of rectangular shaped segments 30, formed longitudinally into a recessed central portion 31 of an outer surface of the strap member 12, with a living hinge 32 therebetween. When the rectangular shaped segments 30 are manually lifted upwardly into an abutting vertical position, the person can hold onto the rectangular shaped segments 30 with one hand and carry the package 18.

As shown in FIGS. 6, 7 and 8, the strap member 12 further includes a pair of flap members 34. A pair of living hinges 36 are provided, with each hinged 36 connected between one end of the strap member 12 and one end of one flap member 34. The flap members 34 in a first position can be folded against the inner surface of the strap member 12 and in a second position can be moved approximately at a ninety degree angle away from the inner surface of the strap member 12.

The adhering structure 14 includes adhesive material 26 applied to the inner surface of each flap member 34. When the flap members 34 go into the second position, the adhesive material 26 will stick fast to the side surfaces 38 of the package 18. Adhesive material 26, as shown in FIGS. 6 and 7, can also be applied to the inner surface of the strap member 12. When the flap members 34 go into the second position, the adhesive material 26 on the inner surface of the strap member 12 will also stick fast to the top surface 16 of the package 18.

Figure 9:
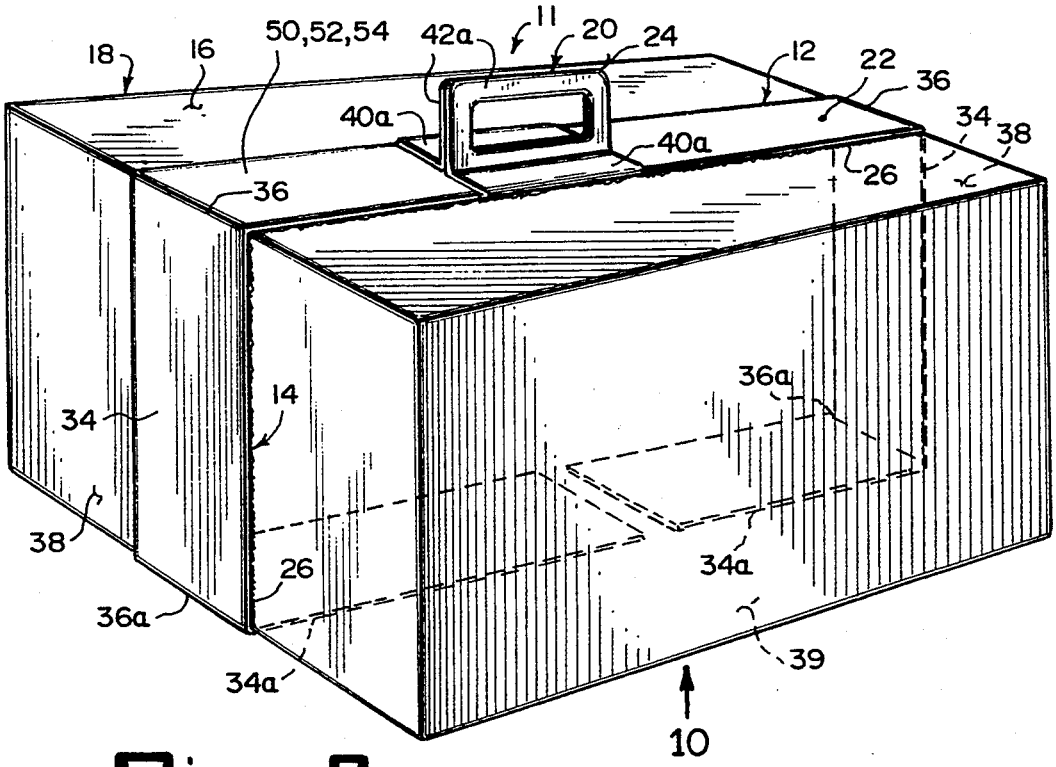
FIG. 9 is a top perspective view of a fourth embodiment of the instant invention attached to a package that is broken away.
Figure 9:
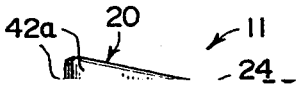
Figure 10:
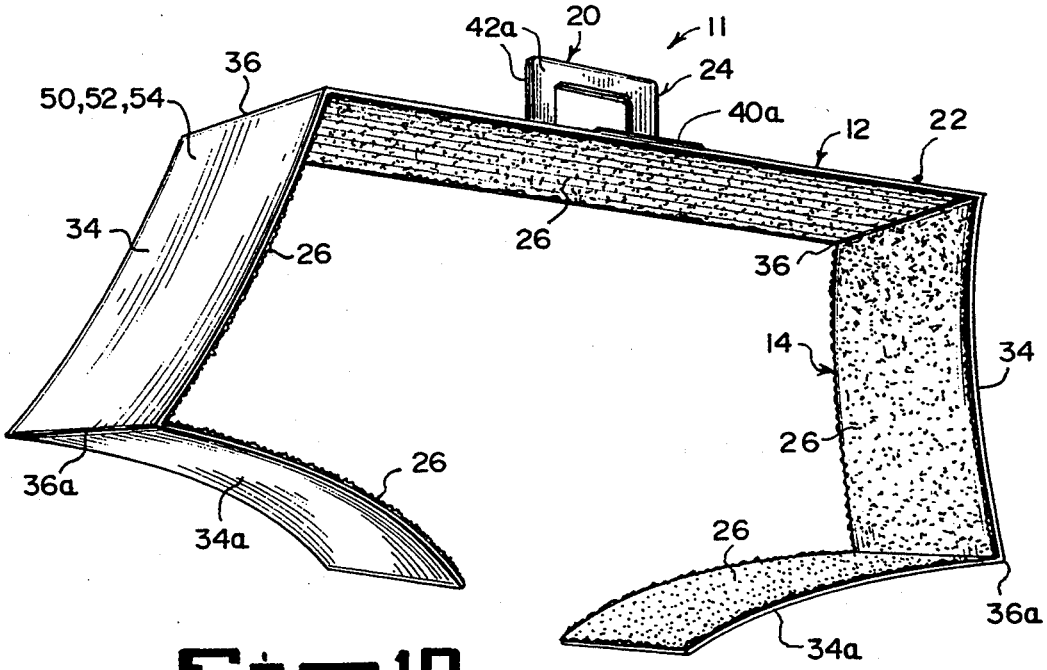
FIG. 10 is a bottom perspective view of the fourth embodiment per se taken in the direction of arrow 10 in FIG. 9.

The strap member 12, as shown in FIGS. 9 and 10, further includes a pair of second flap members **34*a*. A pair of second living hinges 36*a* are provided, with each second hinge 36*a* connected between a second end of one first flap member 34 and an end of the second flap member 34*a*. When the first flap members 34 go into the second position, the second flap members 34***a* can be moved away from the first flap members 34 at approximately a ninety degree angle.

The adhering structure 14 includes adhesive material 26 applied to an inner surface of each second flap member 34*a*. When the first flap members 34 go into the second position, adhesive material 26 on the inner surface of each second flap member 34*a* will stick fast to a bottom surface 39 of the package 18. Adhesive material 26 can also be applied to an inner surface of each first flap member 34. When the first flap members 34 go into the second position, the adhesive material 26 on the inner surfaces of the first flap member 34 will stick fast to the side surfaces 38 of the package 18.

Adhesive material 26 can also be applied to the inner surface of the strap member 12. When the first flap members 34 and the second flap members 34*a* go into the second position, the adhesive material 26 on the inner surface of the strap member 12 will also stick fast to the top surface 16 of the package 12.

In FIGS. 6 and 7, the grip member 24 contains a pair of arms 40 extending from opposite central edges of the strap member 12, with each arm 40 having a D-shaped distal end 42. When the arms 40 are manually lifted upwardly and folded into an abutting vertical position, as shown in FIG. 7, the person can hold onto the D-shaped distal ends 42 with one hand and carry the package 18.

In FIG. 8, the grip member 24 includes a pair of rectangular shaped segments 44, formed transversely into a recessed central portion 45 of the outer surface of the strap member 12, with a living hinge 46 therebetween. When the rectangular shaped segments 44 are manually lifted upwardly into an abutting vertical position, the person can hold onto the rectangular shaped segments 44 with one hand and carry the package 18.

Figure 5:
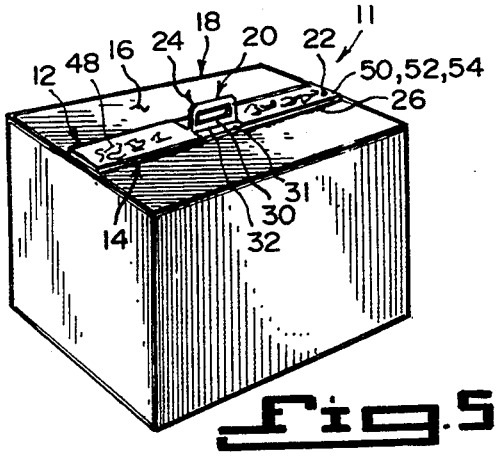
FIG. 5 is a top perspective view taken in the direction of arrow 5 in FIG. 4, showing indicia imprinted on the strap member.

In FIG. 5 indicia 48 is imprinted onto the outer surface of the strap member 12, so as to be used for advertising purposes. The narrow flat piece of pliant material 22 can be paper 50, plastic 52, metal 54 or any other durable materials.

In FIGS. 11 and 12 the grip member 24 is fabricated out of a narrow cylindrical piece of pliant material 56. The strap member 12 and the grip member 24 are integral. The grip member 24 is in the center dividing the strap member 12 into two segments 58. All are out of the same pliant material 56.

The adhering structure 14 includes adhesive material 26, applied to an inner surface of the two segments 58 of the strap member 12. Two protective strips 28 are provided, with each applied to the adhesive material 26 on one segment 58 of the strap member 12. When the two protective strips 28 are manually removed, the adhesive material 26 will be exposed, to allow the two segments 58 of the strap member 12 to stick fast to the front and rear surfaces 60 and 62 of the package 18.

OPERATION OF THE INVENTION

To use the improved packaging handle 11 as shown in FIGS. 1 through 5, the following steps should be taken:

1. Remove the protective strips 28 from the strap member 12.
2. Press the adhesive material 26 against the top surface 16 of the package 18.
3. Lift up the rectangular shaped segments 30 of the grip member 24 until they are in the abutting vertical position.
4. Hold onto the rectangular shaped segments 30, so that one hand can carry the package 18.

To Use the improved packaging handle 11 as shown in FIGS. 6 and 7, the following steps should be taken:

1. Pull down the flap members 34 away from the inner surface of the strap member 12.
2. Make sure that the flap members 34 are approximately at a ninety degree angle to the strap member 12.
3. Press the adhesive material 26 on the strap member 12 against the top surfaces 16 of the package 18.
4. Press the adhesive material 26 on the flap members 34 against the side surfaces 38 of the package 18.
5. Lift up the arms 40 of the grip member 24 and fold them until the D-shaped distal ends 42 are in the abutting vertical position.
6. Hold onto the D-shaped distal ends 42, so that one hand can carry the package 18.

To use the improved packaging handle 11 as shown in FIG. 8, the following steps should be taken:

1. Pull down the flap members 34 away from the inner surface of the strap member 12.
2. Make sure that the flap members 34 are approximately at a ninety degree angle to the strap member 12.
3. Press the adhesive material 26 on the flap members 34 against the side surfaces 38 of the package 18.
4. Lift up the rectangular shaped segments 44 of the grip member 24 until they are in the abutting vertical position.
5. Hold onto the rectangular shaped segments 44, so that one hand can carry the package 18.

To use the improved packaging handle 11, as shown in FIGS. 9 and 10, the following steps should be taken:

1. Pull down the first flap members 34 away from the inner surface of the strap member 12.
2. Make sure that the first flap members 34 are approximately at a ninety degree angle to the strap member 12.
3. Pull down the second flap members 34*a* away from the first flap members 34 to approximately at a ninety degree angle.
4. Press the adhesive material 26 on the strap member 12 against the top surface 16 of the package 18.
5. Press the adhesive material 26 on the first flap members 34 against the side surfaces 38 of the package 18.
6. Press the adhesive material 26 on the second flap members 34*a* against the bottom surface 39 of the package 18.
7. Lift up the arms 40*a* of the grip member 24 and fold them until the distal ends 42*a* are in the abutting vertical position.
8. Hold the distal ends 42*a*, so that one hand can carry the package 18.

To use the improved packaging handle 11, as shown in FIGS. 11 and 12, the following steps should be taken:

1. Remove the two protective strips 28 from the two segments 58 of the strap member 12.
2. Press the adhesive material 26 against the front and rear surfaces 60, 62 of the package 18.
3. Hold onto the grip member 24, so that one hand can carry the package 18.

LIST OF REFERENCE NUMBERS

11 improved packaging handle
12 strap member
14 adhering structure

16 top surface of 18
18 package
20 grasping component
22 narrow flat thin piece of pliant material
24 grip member for 20
26 adhesive material
28 protective strip
30 rectangular shaped segment
31 recessed central portion of 12
32 living hinge between 12 and 30
34 first flap member
34*a* second flap member
36 first living hinge between 12 and 34
36*a* second living hinge between 34 and 34*a*
38 side surface of 18
39 bottom surface of 18
40 arm
40*a* arm
42 D-shaped distal end of 40
42*a* distal end of 40*a*
44 rectangular shaped segment
45 recessed central portion of 12
46 living hinge between 12 and 44
48 indicia on 12
50 paper for 22
52 plastic for 22
54 metal for 22
56 narrow cylindrical piece of pliant material for 24
58 segment of 12
60 front surface of 18
62 rear surface of 18

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved packaging handle which comprises:
a) a strap member, said strap member being fabricated out of a narrow flat thin piece of pliant material;
b) means for adhering said strap member to a package, said adhering means including adhesive material applied to an inner surface of said strap member, and at least one protective strip applied to said adhesive material, so that when at least one protective strip is manually removed, said adhesive material will be exposed to allow said strap member to stick fast to a top surface of the package; and
c) means for grasping, on said strap member, so that a person can carry the package therefrom with one hand, said grasping means being a grip member, said grip member being fabricated out of a narrow flat thin piece of pliant material, said strap member and said grip member being integral and fabricated out of the same narrow flat thin piece of pliant material, said grip member including a pair of rectangular shaped segments formed longitudinally into a recessed central portion of an outer surface of said strap member with a living hinge therebetween, so that when said rectangular shaped segments are manually lifted upwardly into an abutting vertical position, the person can hold onto said rectangular shaped segments with one hand and carry the package.

2. An improved packaging handle as recited in claim 1, wherein said strap member further includes:
a) a pair of flap members; and
b) a pair of living hinges, each said hinge connected between one end of one said strap member and one end of said flap member, so that said flap members in a first position can be folded against an inner surface of said strap member and in a second position can be moved approximately at a ninety degree angle away from the inner surface of said strap member.

3. An improved packaging handle as recited in claim 2, wherein said adhering means includes adhesive material applied to an inner surface of each said flap member, so that when said flap members go into the second position said adhesive material will stick fast to the side surfaces of the package.

4. An improved packaging handle as recited in claim 3, wherein said adhering means further includes adhesive material applied to the inner surface of said strap member, so that when said flap members go into the second position, said adhesive material on the inner surface of said strap member will also stick fast to a top surface of the package.

5. An improved packaging handle as recited in claim 2, wherein said strap member further includes:
a) a pair of second flap members; and
b) a pair of second living hinges, each said second hinge connected between a second end of one said first flap member and an end of said second flap member, so that when said first flap members go into the second position said second flap members can be moved away from said first flap members at approximately a ninety degree angle.

6. An improved packaging handle as recited in claim 5, wherein said adhering means includes adhesive material applied to an inner surface of each said second flap member, so that when said first flap members go into the second position, said adhesive material on the inner surface of each said second flap member will stick fast to a bottom surface of the package.

7. An improved packaging handle as recited in claim 6, wherein said adhering means further includes adhesive material applied to an inner surface of each said first flap member, so that when said first flap members go into the second position, said adhesive material on the inner surfaces of said first flap members will stick fast to the side surfaces of the package.

8. An improved packaging handle as recited in claim 7, wherein said adhering means further includes adhesive material applied to the inner surface of said strap member, so that when said first flap members and said second flap members go into the second position, said adhesive material on the inner surface of said strap member will also stick fast to a top surface of the package.

9. An improved packaging handle as recited in claim 4, wherein said grip member includes a pair of arms extending from opposite central edges of said strap member, with each said arm having a D-shaped distal end, so that when said arms are manually lifted upwardly and folded into an abutting vertical position, the person can hold onto the D-shaped distal ends with one hand and carry the package.

10. An improved packaging handle as recited in claim 9, wherein said grip member includes a pair of rectangular shaped segments formed transversely into a recessed central portion of an outer surface of said strap member with a living hinge therebetween, so that when said rectangular shaped segments are manually lifted upwardly into an abutting vertical position, the person can hold onto said rectangular shaped segments with one hand and carry the package.

11. An improved packaging handle as recited in claim 1, further including indicia imprinted onto an outer surface of said strap member, so as to be used for advertising purposes.

12. An improved packaging handle as recited in claim 1, wherein said narrow flat piece of pliant material is paper.

13. An improved packaging handle as recited in claim 1, wherein said narrow flat piece of pliant material is plastic.

14. An improved packaging handle as recited in claim 1, wherein said narrow flat piece of pliant material is metal.

15. An improved packaging handle as recited in claim 1 wherein said grip member is fabricated out of a narrow cylindrical piece of pliant material.

16. An improved packaging handle as recited in claim 15, wherein said strap member and said grip member are integral, with said grip member in the center dividing said strap member into two segments and are all fabricated out of the same pliant material.

17. An improved packaging handle as recited in claim 16, wherein said adhering means includes:

a) adhesive material applied to an inner surface of said two segments of said strap member; and b) two protective strips, each applied to said adhesive material on said one segment of said strap member, so that when said two protective strips are manually removed, said adhesive material will be exposed to allow said two segments of said strap member to stick fast to a front and rear surface of the package.

* * * * *